US007291259B2

(12) United States Patent
Gupta et al.

(10) Patent No.: US 7,291,259 B2
(45) Date of Patent: Nov. 6, 2007

(54) PROCESS FOR DESULFURIZING HYDROCARBON FUELS AND FUEL COMPONENTS

(75) Inventors: Raghubir P. Gupta, Durham, NC (US); Brian S. Turk, Durham, NC (US)

(73) Assignee: Research Triangle Institute, Research Triangle Park, NC (US)

( * ) Notice: Subject to any disclaimer, the term of this patent is extended or adjusted under 35 U.S.C. 154(b) by 28 days.

(21) Appl. No.: 10/363,677

(22) PCT Filed: Sep. 12, 2001

(86) PCT No.: PCT/US01/26019

§ 371 (c)(1),
(2), (4) Date: Aug. 4, 2003

(87) PCT Pub. No.: WO02/22763

PCT Pub. Date: Mar. 21, 2002

(65) Prior Publication Data

US 2005/0098478 A1 May 12, 2005

Related U.S. Application Data

(60) Provisional application No. 60/232,165, filed on Sep. 11, 2000.

(51) Int. Cl.
*C10G 25/05* (2006.01)

(52) U.S. Cl. ..... 208/299; 208/244; 208/247; 208/120.25

(58) Field of Classification Search ..... 208/247, 208/244, 299, 120.25
See application file for complete search history.

(56) References Cited

U.S. PATENT DOCUMENTS

| | | | | |
|---|---|---|---|---|
| 4,088,736 | A | 5/1978 | Courty et al. | |
| 4,113,606 | A | 9/1978 | Mulaskey | |
| 4,298,460 | A | 11/1981 | Fujimori et al. | |
| 5,045,522 | A | 9/1991 | Kidd | |
| 5,059,302 | A | 10/1991 | Weinberg et al. | |
| 5,254,516 | A | 10/1993 | Gupta et al. | |
| 5,776,331 | A | 7/1998 | Khare et al. | |
| 5,914,288 | A | 6/1999 | Turk et al. | |
| 5,914,292 | A | 6/1999 | Khare et al. | |
| 5,972,835 | A * | 10/1999 | Gupta | 502/439 |
| 6,274,533 | B1 * | 8/2001 | Khare | 502/343 |
| 6,803,343 | B2 * | 10/2004 | Khare | 502/406 |

FOREIGN PATENT DOCUMENTS

WO 99/42201 8/1999

* cited by examiner

*Primary Examiner*—Tam M. Nguyen
(74) *Attorney, Agent, or Firm*—Oblon, Spivak, McClelland, Maier & Neustadt, P.C.

(57) ABSTRACT

Processes are disclosed for removing sulfur, including cyclic and polycyclic organic sulfur components such as thiophenes and benzothiophenes, from a hydrocarbon feedstock including fuels and fuel components. The feedstock is contacted with a regenerable sorbent material capable of selectively adsorbing the sulfur compounds present in the hydrocarbon feedstock in the absence of a hydrodesulfurization catalyst. In one embodiment, the sorbent can be an active metal oxide sulfur sorbent in combination with a refractory inorganic oxide cracking catalyst support. In another embodiment, the sorbent can be a metal-substituted refractory inorganic oxide cracking catalyst wherein the metal is a metal which is capable in its oxide form, of adsorption of reduced sulfur compounds by conversion of the metal oxide to a metal sulfide. The processes are preferably carried out in a transport bed reactor.

96 Claims, 2 Drawing Sheets

PROCESS FOR DESULFURIZING HYDROCARBON FUELS AND FUEL COMPONENTS

FIELD OF THE INVENTION

The present invention relates to the desulfurization of hydrocarbons, particularly hydrocarbon fuels and hydrocarbon fuel components and their precursors. More particularly, the present invention relates to removal of sulfur, primarily organic sulfur, contaminants including organic sulfides, disulfides, mercaptans, thiophenes, benzothiophenes, and dibenzothiophenes, from hydrocarbon fuels such as gasoline, diesel fuels, aviation fuels, and from components and precursors of such fuels such as FCC naphtha, i.e., naphtha from a fluid catalytic cracker (FCC), FCC light cycle oil, coker distillate, and the like.

BACKGROUND OF THE INVENTION

Currently available gasoline contains sulfur contaminants at an average cumulative level exceeding 300 parts per million by weight (ppmw) of sulfur (i.e., calculated based on sulfur weight). On-road application diesel fuel has a higher sulfur content ranging typically from 300 to 2,000 ppmw. Combustion of gasoline and diesel fuels during use in internal combustion engines, in turn, converts the sulfur contaminants into sulfur oxides. The sulfur oxides are environmentally undesirable and also have been found to have a long-term deactivation impact on automotive catalytic converters that are used to remove nitrogen oxide and unburned hydrocarbon contaminants from automotive emissions.

In order to improve air quality, environmental protection agencies of various industrialized countries have therefore announced or proposed new regulations requiring reduction in sulfur content of gasoline, diesel, and other motor fuels. In the United States, the Environmental Protection Agency (EPA) is requiring that the sulfur content of gasolines be reduced to a maximum of 30 ppmw by the year 2005 under recently implemented Tier 2 regulations. Similarly, the EPA has enacted regulations to bring down the sulfur levels in diesel fuel used for on-road application to 15 ppmv or below by 2006. It is anticipated that due to public demand for a cleaner environment, the future will bring calls for even stricter sulfur oxide emissions and fuel specifications; and, as a result, fuels containing nearly zero sulfur levels are being discussed. Accordingly, the new regulations will require sulfur reduction of typically 90% or more by 2005, and perhaps complete sulfur removal thereafter. At the same time, the sulfur content of commercially available crude oils produced in the United States and in neighboring American countries has been generally increasing; thus the new regulations will require more drastic sulfur reduction in the future. Further reductions meeting nearly zero sulfur levels required by expected future regulations will exacerbate this problem further.

Various technologies are currently available or have been proposed which are believed to be capable of reducing sulfur contaminants in gasoline to 30 ppmw or less. According to a recent study conducted by EPA, these available and proposed technologies include hydrotreating and adsorption-based processes (see *Regulatory Impact Analysis—Control of Air Pollution From New Motor Vehicles: Tier 2 Motor Vehicle Emissions Standards and Gasoline Sulfur Control Requirements*, EPA 420-R-99-023, United States Environmental Protection Agency, December 1999, Chapter IV, pp. IV-42-IV-65).

As detailed in the EPA study, the sulfur content of current gasolines is attributable primarily to fluidized catalytic crackers (FCC), or to coker units, which convert heavy boiling stocks to gasoline components or precursors, i.e., naphthas. It has been reported that more than 90% of the sulfur in gasoline comes from streams produced in the FCC unit. The sulfur content of FCC naphtha varies from 150 to 3,000 ppmw depending upon the sulfur concentration of feed and the endpoint of the gasoline product. Accordingly, reduction of sulfur in motor gasoline can be accomplished by FCC feed hydrotreating or by hydrotreating the naphtha cut obtained from the FCC unit. The latter process is preferred because of substantially lower cost resulting from substantially lower volumes of the feedstocks to be processed.

Nevertheless, hydrotreating of FCC naphtha is expensive, both in capital investment, and in operating costs. In particular, hydrotreating of FCC naphtha is typically carried out in a packed-bed or a fixed-bed reactor using various well-known hydrodesulfurization (HDS) catalysts. These catalysts typically contain a Group 8 (other than iron), 9, or 10 transition metal such as cobalt and/or nickel combined with a Group 6 transition metal, particularly molybdenum or tungsten, on a high surface area alumina support ("Group metal" as used herein is based on the new IUPAC format for the Periodic Table of the Elements, which numbers the groups from 1 to 18 in Arabic numerals). Before their use, these catalysts are typically pre-sulfided under controlled reducing conditions to impart their HDS catalytic activity. Other HDS catalysts include platinum, palladium, or like metals supported on alumina. In the presence of HDS catalysts, organic sulfur compounds present in FCC naphtha react with hydrogen and are converted into hydrogen sulfide at temperature and pressures or 300 to 500° C., and 400 to 600 psig. The hydrogen sulfide thus formed can be subsequently and readily removed in a downstream unit by sorbents or other processes such as a combination of amine and Claus processes.

However, during the HDS hydrotreating process, octane number loss can occur by saturation of high-octane containing olefins that are present in FCC naphtha. Moreover, increased olefin saturation is accompanied by increased hydrogen consumption and cost. In addition, there can be a loss in gasoline yield caused by mild cracking which breaks some of the naphtha into smaller, lighter fractions, which are too light for blending into gasoline.

Three proven hydrotreating desulfurization technologies are identified in the EPA report cited previously. However, octane number loss remains a serious problem with all three proven technologies particularly when applied for removal of 90 percent or more sulfur from the FCC naphtha to meet EPA's Tier 2 requirements.

Newly proposed technologies identified in the EPA report include a catalytic distillation technology, called CDTech, which relies upon an HDS catalyst supported in a distillation column to provide reaction of organic sulfur compounds with diene compounds present in FCC naphtha. The resultant thioether reaction product has a higher boiling point and can be removed from the bottom of the distillation column. Similar to conventional hydrotreating processes, this process also uses an HDS catalyst. However, hydrogen consumption and olefin saturation are claimed to be lower compared to conventional hydrotreating processes. The operating cost for sulfur removal using the CDTech process is reported to be 25% lower than conventional hydrotreating processes for the same degree of sulfur removal.

Two emerging adsorption-based desulfurization processes are also discussed in the EPA report. One process, named IRVAD, adsorbs heteroatom-containing hydrocarbon compounds, including sulfur, nitrogen, and oxygen compounds, present in FCC naphtha onto an alumina-based adsorbent in liquid phase (see U.S. Pat. No. 5,730,860, issued Mar. 24, 1998 to Irvine). The adsorbent is fluidized in a tall column and continuously removed and regenerated using hydrogen in a second column. The regenerated catalyst is then recycled back into the reactor. The regeneration of spent adsorbent produces a hydrocarbon stream containing about 1 wt % sulfur, which can be treated using conventional processes. While the inventors have claimed an overall cost of sulfur removal as low as 0.77 cents per gallon of gasoline compared to 5 to 8 cents for conventional hydrotreating processes, serious process and system integration issues still remain with this technology, which are hampering its commercial deployment.

The other emerging adsorption-based desulfurization technology named as the SZorb process is being developed by the Phillips Petroleum Company. It is understood that this process uses an adsorbent/catalyst comprising one or more metallic promoters, such as a combination of nickel and cobalt, in a zero valence state to selectively remove sulfur compounds from FCC naphtha in the presence of hydrogen. As the adsorbent/catalyst becomes saturated with sulfur compounds, it is sent to a regeneration unit where it is treated with an oxygen-containing gas for removal of the sulfur as sulfur dioxide. The oxidized adsorbent/catalyst is further treated with hydrogen in a downstream reducing unit presumably to reduce some of the metal oxide/s present in the adsorbent/catalyst composition to their reduced forms. The reduced adsorbent/catalyst is then fed to the sulfur removal unit, along with hydrogen, for further desulfurization of FCC naphtha. This process is carried out at a temperature between about 250 to about 350° C. (about 500 to about 700° F.) and a pressure of 100 to 300 psig. Phillips proposes to use conventional bubbling-bed fluidized-beds for adsorption and regeneration reactors, which will have inherent limitation on throughput of the FCC naphtha feed that can be processed in this system. Phillips claims that this process can remove about 97% of the sulfur from FCC naphtha with a 1 to 1.5 point loss in octane number and with an operating cost of 1.5 to 2 cents per gallon of gasoline. However, the need for a two-step regeneration process, consumption of hydrogen and associated octane number loss, and the use of low throughput bubbling-bed systems are some of the major drawbacks of this technology. Recent information from Phillips indicates that this process is being adapted for desulfurization of diesel.

Various other desulfurization processes are known or have been proposed. For example, U.S. Pat. No. 3,063,936, issued on Nov. 13, 1962 to Pearce et al. discloses that sulfur reduction can be achieved for straight-run naphtha feedstocks from 357 ppmw to 10-26 ppmw levels by hydrotreating at 380° C. using an alumina-supported cobalt molybdate catalyst. According to Pearce et al., a similar degree of desulfurization may be achieved by passing the straight-run naphtha with or without hydrogen, over a contact material comprising zinc oxide, manganese oxide, or iron oxide at 350 to 450° C. Pearce et al. propose to increase sulfur removal by treating the straight run naphtha feeds in a three-stage process in which the hydrocarbon oil is treated with sulfuric acid in the first step, a hydrotreating process employing an alumina-supported cobalt molybdate catalyst is used in the second step, and an adsorption process, preferably using zinc oxide is used for removal of hydrogen sulfide formed in the hydrotreating step as the third step. The process is said to be suitable only for treating feedstocks that are substantially free from ethylenically or acetylenically unsaturated compounds. In particular, Pearce et al. disclose that the process is not suitable for treating feedstocks, such as hydrocarbons obtained as a result of thermal cracking processes that contain substantial amounts of ethylenically or acetylenically unsaturated compounds such as full-range FCC naphtha, which contains about 30% olefins.

U.S. Pat. No. 5,157,201 discloses that organic sulfur species, primarily comprising organic sulfides, disulfides, and mercaptans, can be adsorbed from olefin streams, without saturating the olefins, by contacting the feed with a metal oxide adsorbent at relatively low temperatures (50 to 75° C.), in the absence of hydrogen. The metal oxide adsorbent includes metal oxides selected from a group consisting of a mixture of cobalt and molybdenum oxides, a mixture of nickel and molybdenum oxides and nickel oxide supported on an inert support. The adsorbed organic sulfur compounds are removed from the sorbent by purging with an inert gas while heating at a temperature of about 200° C. for at least about 45 minutes. Although such low-temperature adsorption processes avoid any olefin saturation, these processes are limited to removal of lighter sulfur compounds such as mercaptans and organic sulfides and disulfides. These processes cannot be used effectively for removal of thiophenes, benzothiophenes, and higher cyclic sulfur compounds, which typically account for greater than 50% of the sulfur in FCC naphtha.

In summary, currently available and proposed technologies for reducing sulfur content of FCC naphtha feedstocks to levels of 30 ppmw or less are capital intensive, operationally complex, typically require significant hydrogen consumption, can severely reduce octane number values and/or result in loss in yield, and rely on expensive hydrotreating catalysts in whole or in part. In addition, the existing and proposed technologies rely on fixed-bed or bubbling-bed reactors resulting in limited throughputs and substantial capital investment.

SUMMARY OF THE INVENTION

The present invention accomplishes sulfur reduction in gasoline and diesel fuels, components and precursors of gasoline and diesel fuels such as naphthas, i.e., full and medium range FCC naphthas, coker naphthas, straight run naphthas, visbreaker naphthas, and thermally cracked naphthas, light cycle oils, coker distillates, straight-run diesel, hydrocracker diesel, and the like, without relying on hydrotreating processes that employ costly transition metal HDS catalysts. Accordingly, the invention can minimize or eliminate various known disadvantages of conventional and proposed desulfurization processes for producing low-sulfur gasoline and diesel fuels, including octane number loss, olefin content reduction, and/or yield loss in desulfurized products, hydrogen consumption and its associated costs, the high cost of manufacturing and regenerating HDS catalysts, and the disposal costs associated with various environmentally undesirable HDS catalysts. In preferred embodiments, the present invention can accomplish substantial sulfur removal at high throughput levels, thereby allowing a significant reduction in the capital investment required to achieve large scale production of low-sulfur gasoline, diesel, and related fuels.

In accordance with one aspect of the present invention, a normally liquid hydrocarbon fuel or fuel component, such as an FCC naphtha, FCC light cycle oil, coker distillate, straight run diesel fraction, or the like, is treated at an elevated temperature, preferably a temperature above about 300° C. (572° F.), with an active metal oxide sulfur sorbent, preferably a zinc oxide-based or iron oxide-based sorbent, in the absence of an active HDS catalyst, to reduce sulfur contaminant levels to less than about 30 ppmw, sulfur. Sulfur-laden sorbent is separated from the desulfurized hydrocarbon product and is preferably regenerated by treatment with an oxygen-containing gas, e.g., air, and then recycled for use in the desulfurization operation. The invention is applicable to hydrocarbon fuels and to hydrocarbon fuel fractions and precursors, of various sulfur contents, for example: FCC naphtha having an average sulfur content of between about 150 and about 3,000 ppmw, more typically, between about 500 to about 2,000 ppmw; diesel fuel blends, precursors and fractions such as light cycle oil, coker distillate and straight run diesel fractions having an average sulfur content between about 5,000 and about 30,000 ppmw, more typically, between about 7,000 and about 20,000 ppmw. The process of this invention is equally applicable to partially desulfurized feedstocks such as hydrotreated FCC naphtha and diesel, to reduce their sulfur content to below 30 ppmw.

The process of the invention can be carried out with or without addition of hydrogen to the feed; however, it is preferred to add a sufficient amount of hydrogen to the feed to avoid coking of the feed as it is heated to the elevated temperatures required for desulfurization. Because no active HDS catalyst is used in the present process, hydrogen addition to minimize coking can typically be achieved with minimal or substantially no hydrogen consumption so that the hydrogen can be recovered from the desulfurized process effluent and recycled. Moreover, because of the substantial absence of an HDS catalyst, saturation of desirable olefins in the hydrocarbon feed can be avoided or minimized even at high temperature reaction conditions, and even in the presence of added hydrogen. Furthermore, the hydrogen gas stream used in the process can be of relatively low purity; for example, a waste stream containing hydrogen, as may be found in a refinery or petrochemical plant. Moreover, because no active HDS catalyst is required in the present invention, no hydrogen treatment is required for regeneration or reactivation of the sorbent.

The present inventors have further found that the active metal oxide sulfur sorbents, particularly zinc oxide-based and iron oxide-based sorbents, when used in combination with a refractory inorganic oxide cracking catalyst, e.g., alumina, are capable of removing both straight chain organic sulfur components such as organic sulfides, disulfides, and mercaptans, and cyclic organic sulfur components including substituted and unsubstituted thiophenes, benzothiophenes, and, to some extent, dibenzothiophenes from hydrocarbon fuels, their fractions and precursors, without hydrotreating. In this regard, the present inventors have discovered that a refractory inorganic oxide cracking catalyst, such as alumina, silica, an aluminosilicate or a metal stabilized refractory inorganic oxide cracking catalyst such as metal stabilized alumina, when used to support, or otherwise in combination with the active metal oxide sulfur sorbent, has catalytic activity for selectively cracking cyclic organic sulfur compounds to provide a hydrocarbon and a sulfur species. The sulfur species can be captured by the cracking catalyst or by the active metal oxide sulfur sorbent as a metal sulfide or a metal-sulfur complex. Although prior art processes have primarily relied on hydrotreating of FCC naphthas and diesel fuel fractions and components using HDS catalysts to convert organic sulfur contaminants to hydrogen sulfide, followed by amine and Claus process treatments for removal of hydrogen sulfide, it has now been found that active metal oxide sorbents, preferably zinc oxide-based and iron oxide-based sorbents, supported on or otherwise combined with a refractory inorganic oxide cracking catalyst, can directly remove organic sulfur contaminants from hydrocarbon feedstocks at elevated temperatures without requiring use of an active HDS catalyst. In turn, detrimental aspects of hydrotreating-desulfurization processes, such as octane number reduction, and/or olefins loss, can be minimized or avoided in accord with the present invention.

The active metal oxide sulfur sorbents and refractory inorganic oxide cracking catalyst are preferably used simultaneously to treat the hydrocarbon fuel feed; however they can alternatively be used sequentially in the process of the invention. In preferred embodiments in which the active metal oxide sulfur sorbent and the refractory inorganic oxide cracking catalyst are used simultaneously, the active metal oxide sulfur sorbent is supported on or combined with a refractory inorganic oxide cracking catalyst such as alumina, silica, aluminosilicate, zeolite or the like. This can also provide high temperature stability and extremely high attrition resistance to the sorbent particles.

According to another aspect of the invention, it has been found that certain metal-substituted refractory inorganic oxide cracking catalysts can remove organic sulfur compounds from hydrocarbon feeds, and can also remove sulfur from at least some of the organic sulfur compounds in hydrocarbon feeds, particularly cyclic sulfur compounds such as thiophenes and benzothiophenes, without requiring use of an HDS catalyst or hydrotreating of the feed. The metal, which can be zinc in one currently preferred embodiment, or iron in another currently preferred embodiment, is more generally selected from the group of metals, which are capable in their oxide form, of removing reduced sulfur compounds from gaseous streams by conversion of the metal oxide to a metal sulfide, such metal oxides being known in the art. The refractory inorganic oxide cracking catalyst can be fully, or only partially, reacted with the metal. The metal-substituted refractory inorganic oxide cracking catalyst can be prepared according to processes well known in the art and is advantageously prepared by partially or fully reacting a metal oxide sulfur sorbent with a refractory inorganic oxide cracking catalyst, such as alumina, silica, an aluminosilicate or the like, to form the corresponding metal aluminate, silicate, aluminosilicate or the like. Suitable active metal oxide sorbents for use in the process of the invention include sorbents based on zinc oxide, zinc titanate, zinc ferrite, iron oxide, iron titanate, manganese oxide, cerium oxide, copper oxide, copper cerium oxide, copper ferrite, copper titanate, copper chromium oxide, vanadium oxide, calcium oxide, calcium carbonate, magnesium oxide, magnesium carbonate, and mixtures thereof.

In particular, the metal-substituted inorganic oxide cracking catalyst sorbent, i.e., metal aluminate, silicate, aluminosilicate or the like, can achieve full or partial conversion of organic sulfur compounds, including cyclic sulfur compounds such as thiophenes and benzothiophenes, to a metal sulfide or a metal-sulfur complex. Such metal-substituted inorganic oxide cracking catalyst sorbents can be used in accordance with the invention to treat a hydrocarbon fuel component, precursor, or blend, preferably an FCC naphtha, or a diesel fuel precursor, component, or blend, at an elevated temperature, preferably above about 300° C. (572° F.), and the treated hydrocarbon stream is then separated from the sulfur-laden sorbent to provide a hydrocarbon product having a sulfur contaminant level preferably of less than about 30 ppmw, without requiring hydrotreating of the feed using an active HDS catalyst. Moreover, such metal-substituted inorganic oxide cracking catalyst sorbents also possess high mechanical strength and attrition resistance. Currently preferred metal-substituted inorganic oxide materials include zinc aluminate, iron aluminate and combinations thereof.

In preferred embodiments of the invention, the sulfur-laden sorbent employed in the desulfurization process of the invention is regenerable by treatment with oxygen at an elevated temperature. According to one currently preferred embodiment of the invention, the regenerable sorbent is an active metal oxide sulfur sorbent supported on, or otherwise combined with a metal-substituted refractory inorganic oxide cracking catalyst, wherein all or a portion of the metal component of the metal-substituted refractory inorganic oxide is the same metal as the metal of the active metal oxide sulfur sorbent. In particular, such regenerable sorbents are used to remove sulfur compounds from a hydrocarbon fuel component feed, to achieve sulfur contaminant levels of less than about 30 ppmw of total sulfur in the product effluent, without requiring hydrotreating of the feed using an active HDS catalyst. The combination of the metal oxide sulfur sorbent and metal refractory inorganic oxide cracking catalyst, e.g., zinc oxide/zinc aluminate or iron oxide/iron aluminate, can be particularly desirable to prevent or minimize deactivation of the sulfur removal activity of the sorbent during the adsorption-regeneration process. In a currently preferred embodiment, a zinc titanate and/or iron oxide sorbent is supported on an alumina or a metal aluminate, preferably zinc and/or iron aluminate, support.

The sulfur-laden sorbent used to remove sulfur compounds from hydrocarbon feedstocks in the process of the present invention, is regenerated by contacting the sorbent with an oxygen-containing gas, preferably air, at a temperature sufficient to cause the sulfur present on the sorbent to react with oxygen to form sulfur dioxide. Typically, the equilibrium temperature in the regeneration zone will exceed a temperature of about 425° C. (800° F.). In one preferred embodiment of the invention, regeneration can be initiated or supplemented by addition of the metal sulfide additives disclosed in U.S. Pat. No. 5,914,288, issued on Jun. 22, 1999 to Turk et al.; the disclosure of which is incorporated herein by reference. As disclosed in the aforesaid Turk et al. patent, a preferred metal sulfide initiator is iron pyrite mineral ore.

The regeneration reaction converts the sulfur-laden sorbent, to the active metal oxide form, for example, to zinc or iron oxide, zinc titanate, or zinc or iron aluminate, and the regenerated sorbent is returned directly to the desulfurization zone. Because the sorbents used in the process of the present invention do not include an active HDS catalyst component, no separate hydrogenation treatment is necessary for regenerating the sorbents to an active state. Accordingly, the energy cost, hydrogen consumption, and reaction vessels required for hydrogen treatment of hydrogenation catalysts are avoided in the process of the present invention.

In one preferred embodiment the invention, the desulfurization process is carried out employing a transport bed reactor with a vapor residence time of less than about 20 seconds, more typically less than about 10 seconds. Nevertheless, high sulfur containing hydrocarbon feedstocks, i.e., having a sulfur content greater than about 150-300 ppmw, more typically greater than about 600 ppmw, can be desulfurized in accord with the invention to achieve sulfur reduction to less than 30 ppmw, more typically less than 10 ppmw. The extremely high throughput process according to this aspect of the invention greatly reduces capital investment since a relatively small reactor can be used for treating substantial quantities of hydrocarbon feedstocks. Use of a high throughput transport reactor is possible because of the extremely high attrition resistance of preferred sorbents used in the present invention. This unique combination of extremely high attrition resistance, allowing these sorbents to be used in a transport reactor, and relatively high activity for selectively cracking cyclic sulfur compounds in hydrocarbon feedstocks combined with sorption activity of active metal oxide component of the sorbent for various inorganic and organic sulfur compounds provides significant benefits and advantages as compared to processes of the prior art.

In another preferred embodiment of the invention, the desulfurization process is carried out employing a bubbling bed reactor to treat hydrocarbon fuel feedstocks having an initial sulfur content greater than about 150-300 ppmw, more typically greater than about 600 ppmw, in order to achieve sulfur reduction to less than 30 ppmw, more typically less than 10 ppmw. Bubbling bed reactors, which can provide excellent gas-solid contact and significant process and capital cost benefits as compared to prior art fixed and packed bed processes, can be employed in accord with the invention using various preferred, high attrition resistance sorbents.

According to another aspect of the invention, sulfur contaminants are removed from an FCC hydrocarbon stream by treating the stream under conventional FCC process conditions, with a regenerable sorbent comprising an active metal oxide sulfur sorbent supported on, or otherwise combined with a refractory inorganic oxide cracking catalyst, preferably comprising a metal substituent, as discussed previously. Advantageously, desulfurization of the FCC hydrocarbon process stream is accomplished simultaneously with the FCC process by adding the sorbent to the FCC riser, e.g., as an additive to the FCC catalyst. According to this aspect of the invention, sulfur compounds initially present in the FCC feedstock, or generated during the FCC process, are selectively captured by the sorbent in the FCC riser. The sulfur-laden sorbent is then sent to the FCC regenerator along with the carbon-laden FCC catalyst where it is regenerated by the oxygen-containing gas, typically air, which is used to regenerate the FCC catalyst. During regeneration, sulfur carried by the sorbent is converted to a sulfur dioxide-containing gas stream that can be treated for sulfur removal in a downstream process unit such as a sulfur dioxide scrubber.

Desulfurization in combination with an FCC operation according to this aspect of the invention is particularly desirable since most of the sulfur (>90%) in gasoline comes from the naphtha produced by conventional FCC treatment. In this regard, the FCC operation is used to upgrade the less desirable portions in crude oil as is well known to those skilled in the art. Because such less desirable portions of oil include substantial quantities of undesirable sulfur-containing components, the product streams generated by the FCC unit also have high sulfur contents. Thus, although some of the sulfur initially in the feed to a conventional FCC unit is removed as $H_2S$ generated during cracking and is collected as non-condensable gas, a substantial portion of the sulfur remains in the FCC product as organic sulfur contaminants, distributed among the various FCC product fractions including FCC naphtha, light cycle oil (LCO), heavy cycle oil (HCO) and the bottoms fraction. Typical sulfur compounds found in FCC naphtha and LCO are essentially heavy thiophenic materials, which are very difficult to convert into $H_2S$ during the catalytic cracking process in a FCC reactor.

According to this aspect of the invention, the active metal oxide sulfur sorbent is added to the FCC catalyst in an amount sufficient to achieve removal of at least about 50 wt. % of sulfur compounds from the FCC naphtha product, i.e., the FCC liquid product fraction having a final boiling point (FBP) less than about 430° F. More preferably, the active metal oxide sulfur sorbent is also active for removal of sulfur contaminants from heavier FCC product fractions and is added to the FCC catalyst in an amount sufficient to achieve removal of at least about 50 wt. % of sulfur compounds from the FCC naphtha and LCO product fractions, i.e., the FCC liquid product fraction having an FBP of less than about 650° F. In currently preferred embodiments according this aspect of the invention, the active metal oxide sulfur sorbent is added to the FCC catalyst in an amount of from about 1 to about 10 wt %, based on the weight of the FCC catalyst.

BRIEF DESCRIPTION OF THE DRAWINGS

In the drawings which form a portion of the original disclosure of this application.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
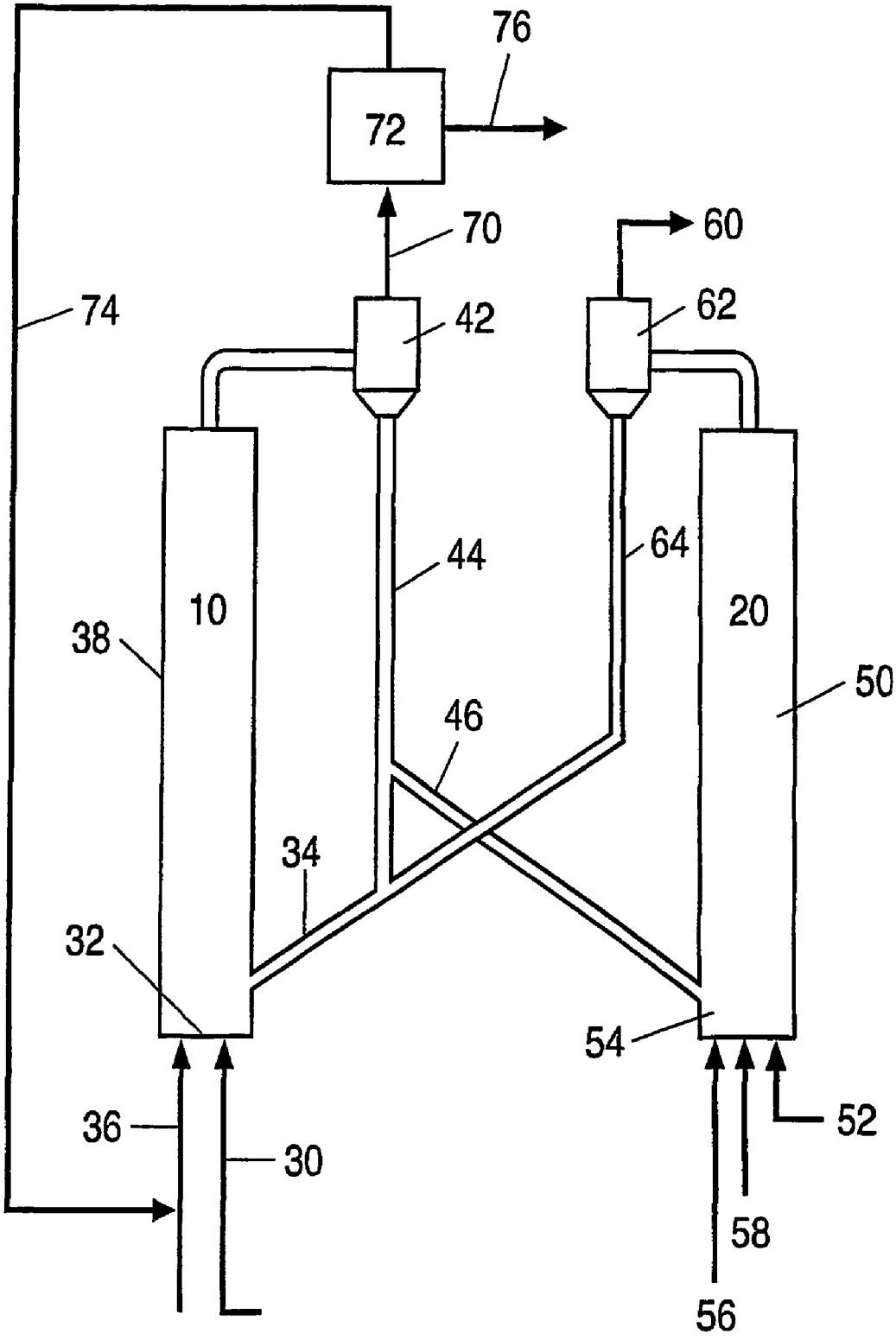
FIG. 1 is a schematic view of a preferred desulfurization and regeneration process according to the present invention.

FIG. 1 illustrates a preferred hydrocarbon feedstock desulfurization process according to the present invention. As shown in FIG. 1, the process includes a desulfurization zone 10 and a regeneration zone 20. In a preferred process according to the invention, and illustrated in the drawing, each of the desulfurization zone 10, and the regeneration zone 20, is defined by a transport bed reactor. It will be apparent to the skilled artisan however that other conventional fluidized bed reactors, including bubbling bed, circulating bed, and riser reactors can be used in the process of the invention. In addition, the hydrocarbon feedstock desulfurization process of the present invention can be conducted using other conventional catalytic reactors including fixed bed and moving bed reactors, such reactors being well known to those skilled in the art.

Preferred transport bed reactors are similarly known to those skilled in the art and are described in, for example, Campbell, William N. and Henningsen, Gunnar B., *Hot Gas Desulfurization Using Transport Reactors*, publication from the M. W. Kellogg Company, pp 1059-64, 12th Annual International Pittsburgh Coal Conference Proceedings, September 1995, which is incorporated in its entirety herein by reference. Transport bed reactors are also described in U.S. Pat. No. 5,447,702, issued on Sep. 5, 1995 to Campbell et al., which is incorporated herein in its entirety by reference.

As illustrated in FIG. 1, a vaporized sulfur containing hydrocarbon feedstock 30, which can be FCC naphtha, is fed at a predetermined velocity through an inlet 32 into the desulfurization zone 10 in admixture with a sulfur sorbent comprising an active metal oxide sorbent, or a metal-substituted refractory inorganic oxide cracking catalyst, preferably a sorbent comprising both, i.e., an active metal oxide sorbent supported on, or otherwise combined with a metal-substituted refractory inorganic oxide cracking catalyst. The hydrocarbon feed 30, including added sorbent, is fed by means of inlet 34 at a temperature between about 300° C. (572° F.) and about 600° C. (1112° F.), preferably at a temperature between about 371° C. (700° F.) and about 538° C. (1000° F.). Optional hydrogen feed 36 is also introduced into the desulfurization zone 10 via inlet 32. The combined hydrogen, hydrocarbon and sorbent stream is transported upwardly through a riser pipe 38 during a relatively short time period of less than about 20 seconds, typically less than about 10 seconds for achieving desulfurization of the feed stream 30. Typically, the superficial gas velocity is between about 5 and about 40 ft/sec, more preferably between about 10 and about 30 ft/sec. The desulfurization zone 10 may have more than one section. In one of the preferred option, the desulfurization zone 10 will consist of two sections, namely a mixing zone in the bottom and a riser zone at the top. The relative length and diameter of these sections will depend on the kinetics of desulfurization reaction, residence time required, sulfur content of the hydrocarbon feedstock, and feedstock throughput, as will be well known to those skilled in the art.

The hydrocarbon feedstock 30 treated in accordance with the process of the present invention is preferably a normally liquid hydrocarbon fuel or fuel component. The term "normally liquid" means liquid at Standard Temperature and Pressure (STP) conditions as will be apparent to the skilled artisan. Although the feedstock 30 is an FCC naphtha constituting a component or fraction of an automotive gasoline fuel in one preferred embodiment of the invention, the invention is equally applicable to other hydrocarbon fuel feedstocks, and to precursors and components thereof. In particular, the invention is applicable to diesel fuel, aviation fuel, and the like, and to components and precursors thereof including, for example, coker naphthas, thermally cracked naphthas, full-range FCC naphthas, light cycle oils, straight-run distillate fractions, and the like. In this regard, it will be appreciated that the hydrocarbon feedstock 30 supplied to the desulfurization zone 10, can have differing boiling point ranges, and will contain varying levels of various organic sulfur contaminants typically including organic sulfides and disulfides, mercaptans, substituted and unsubstituted thiophenes, benzothiophenes, and dibenzothiophenes. In the case of FCC naphtha, the concentration of these sulfur compounds depends on boiling point cut from the fractionator and sulfur content of the feed to the FCC, and typically exceeds 150 ppmw, and more typically exceeds 300 ppmw as discussed previously. In the case of diesel fuel components and blends, the sulfur content is typically higher. In particular, diesel is typically formed from a blend comprising light cycle oil recovered from an FCC unit, a distillate recovered from a coker unit (coker distillate), and a straight-run fraction recovered from the crude fractionation unit. Light cycle oils and coker distillates typically have sulfur contents in the range of from about. 5,000 to about 30,000 ppmw. Straight-run fractions used in diesel fuels can be derived from sweet or sour crude, and typically have different sulfur content ranges, which in the case of sweet crude straight-run fractions, range from about 300 to about 5,000 ppmw, and in the case of sour crude straight-run fractions, range from about 5000 to about 30,000 ppmw. In turn, the complete diesel fuel blend, prior to a conventional hydrotreating step, typically has a sulfur content of up to about 2000 ppmw, and in some cases can have a sulfur content ranging from about 5000 to about 30,000 ppmw.

The process of the invention is equally applicable to achieve substantial sulfur reduction in partially desulfurized feedstocks such as hydrotreated FCC naphtha and hydrotreated diesel blends and components to reduce their sulfur content to below 30 ppmw, while avoiding olefin saturation, product yield losses and/or increased processing costs which can accompany sulfur removal by HDS processes, particularly in the case of cyclic and polycylic organic sulfur contaminants. In particular, the desulfurization process of the invention can be employed to accomplish a polishing step or the like for removal of cyclic and polycylic organic sulfur contaminants from relatively low-sulfur feedstocks, in order to achieve removal of at least about 25 wt. %, more preferably at least about 50 wt. %, of the cyclic and polycyclic organic sulfur contaminants initially present in a low-sulfur hydrocarbon fuel, fuel component or fuel precursor feed.

In embodiments of the invention wherein diesel fuels and/or their components or precursors are treated to reduce sulfur, the preferred process conditions and/apparatus can accordingly be varied depending on the particular feedstock, and sulfur content as will be apparent to those of skill in the art. Thus, when a diesel fuel, or precursor(s) or component(s) thereof, is treated for sulfur removal in the process illustrated in FIG. 1, a high sulfur diesel feed 30, is fed in vapor form into the desulfurization zone 10 in admixture with an active metal oxide sorbent at a temperature of between about 350° C. (662° F.) and about 750° C. (1382° F.), preferably at a temperature between about 450° C. (842° F.) and about 700° C. (1292° F.). The combined diesel feed and sorbent stream, with or without optional hydrogen feed 36 is transported upwardly through riser pipe 38 during a relatively short residence time of less than about 20 seconds, to thereby achieve desulfurization of the diesel feed 30.

Although not specifically illustrated in the drawings, the desulfurization process of the invention can be advantageously carried out employing a conventional bubbling bed reactor to accomplish gas-solid contact between the hydrocarbon fuel feedstock and the active metal oxide sorbent. Bubbling bed reactors can be advantageously employed to treat any of the various fuels, fuel components, and fuel precursors discussed previously, and can be particularly beneficial for treating hydrocarbon fuels and fractions having boiling point ranges exceeding that of FCC naphtha in view of the enhanced gas-solid contact that can be achieved in bubbling bed reactors as compared to transport bed reactors. Bubbling bed reactors provide excellent gas-solid contact and significant process and capital cost benefits as compared to fixed and packed bed reactors which are typically used in prior art hydrodesulfurization processes in order to minimize olefin saturation and product yield losses. The active metal oxide sulfur sorbent employed to treat hydrocarbon feedstocks in bubbling bed reactors according to this embodiment of the invention, is advantageously a high attrition resistance sorbent, discussed in greater detail below. As indicated previously, the desulfurization process of the present invention can alternatively be conducted using other conventional catalytic reactors including fixed bed and moving bed reactors with substantial benefits as compared to prior art hydrodesulfurization processes.

The active metal oxide sulfur sorbent employed in the invention includes at least one active metal oxide capable of removing sulfur compounds from the sulfur-containing fuel feed stream to form a metal sulfide or a metal-sulfur complex. The term "active metal oxide sulfur sorbent" as used herein refers to active metal oxides and mixed active metal oxides, including different oxides of the same elements, for example, zinc titanate which includes various oxides of the formula $ZnO.n(TiO_2)$, or various iron oxides of the formula $Fe_x(O)_y$, and to mixed oxides of different metals including active metal oxides derived from calcining of active metal oxides, and also to carbonates. Such active metal oxide sorbents can include binders that are mixed or reacted with the active metal oxide, supports that support the metal oxide, and the like as will be apparent to the skilled artisan. Advantageously, the sorbents used in the present invention are regenerable by treatment with oxygen at an elevated temperature. For purposes of the present invention, a sorbent is considered regenerable when it can be used for desulfurization of a hydrocarbon feed, and can thereafter be reactivated at least once by treatment with oxygen at an elevated temperature, to a sulfur removal activity level greater than 50% of the original sulfur activity level of the sorbent (based on the original weight percent sulfur adsorbing capacity of the sorbent under the same conditions). Active metal oxide sorbents exhibiting good adsorption rates and capacity for sulfur compounds, good regenerability without appreciable loss of efficiency or efficacy, and high attrition resistance are preferred for use in this invention. These sorbents chemically react with the sulfur atoms of the organic sulfur compounds in the feed stream and the active metal oxide is thus converted into a metal sulfide and/or a metal-sulfur complex.

Suitable active metal oxide sorbents for use in the process of the invention, include sorbents based on zinc oxide, zinc titanate, zinc aluminate, zinc silicate, zinc ferrite, iron oxide, iron aluminate, iron zinc oxide, manganese oxide, cerium oxide, copper oxide, copper cerium oxide, copper titanate, copper chromium oxide, copper aluminate, vanadium oxide, calcium oxide, calcium carbonate, magnesium oxide, magnesium carbonate, and mixtures thereof, particularly mixtures of zinc oxides with an iron oxide, and/or copper oxide.

In one particularly preferred embodiment of the invention, the active metal oxide is supported on or otherwise combined with a refractory inorganic oxide cracking catalyst support. Refractory inorganic oxide cracking catalyst support materials are well known to those skilled in the art and include various aluminas, silicas, aluminosilicates, and zeolites. Refractory inorganic oxide cracking catalysts support materials which have been reacted with a metal or metal oxide, such as metal or metal oxide aluminates, metal or metal oxide silicates, metal or metal oxide aluminosilicates, and metal or metal oxide zeolites are currently preferred for use in the present invention. One particularly preferred supported active metal oxide for use in the present invention is a zinc aluminate supported zinc titanate as disclosed in PCT Application WO 99/42201 A1, published Aug. 26, 1999, entitled "Attrition Resistant, Zinc Titanate-Containing, Reduced Sulfur Sorbents", which is hereby incorporated herein by reference. Other metal oxide aluminate supports described in the aforesaid PCT Application are also suitable for use in the present invention. The metal oxide aluminate supported zinc titanate sorbent materials can be formulated to be highly attrition resistant even at high temperatures, while maintaining substantial chemical activity and regenerability. Other metal and metal oxide aluminates such as iron aluminates, and/or copper aluminates, are also, or alternatively, desirably employed in preferred embodiments of the invention to likewise provide high attrition resistance along with substantial sulfur-removal capacity and good regenerability.

Although the active metal oxide sulfur sorbent is preferably supported by, or combined with, the refractory inorganic oxide cracking catalyst so that the hydrocarbon fuel stream is treated simultaneously by the active metal oxide sorbent and the refractory inorganic oxide cracking catalyst, the present invention also includes processes in which the hydrocarbon fuel stream is treated with the refractory inorganic oxide cracking catalyst and the active metal oxide sorbent sequentially, for example, by passing the hydrocarbon fuel stream through sequential treatment zones including the respective refractory inorganic oxide cracking catalyst and metal oxide sorbent.

Mixed active metal oxide sulfur sorbents are particularly desirable in some advantageous embodiments of the invention. For example, it is known that the sulfur adsorption capabilities of active metal oxide sorbents vary from sorbent to sorbent at different temperatures. It has been found that the reaction kinetics associated with sulfur conversion and sorption by zinc oxide-based sorbents can be substantially enhanced at temperatures below about 525° C. (1000° F.) by incorporating a minor amount of an active metal sorbent which adsorbs sulfur at lower temperatures than zinc oxide sorbents. One such preferred additional active metal oxide sorbent is copper oxide which may be included in an amount ranging from about 5 to about 45 weight percent, preferably about 5 to about 20 weight percent based on the weight of the active zinc oxide component (for example, zinc titanate). Other promoters may include oxides of iron, silver, gold, or any combination thereof. Other desirable mixed metal oxide sorbents include iron oxides mixed with zinc oxides and/or zinc titanates and/or copper oxides.

Numerous other active metal oxide sorbents can also be used in the process of the invention. Exemplary active metal oxide sorbents are disclosed in U.S. Pat. No. 5,254,516, issued Oct. 19, 1993 to Gupta et al., U.S. Pat. No. 5,714,431, issued Feb. 3, 1998 to Gupta et al., and U.S. Pat. No. 5,972,835, issued Oct. 26, 1999 to Gupta. Still other exemplary active metal oxide sorbents include sorbents which are marketed by Philips Petroleum Company and contain a zinc oxide-based sorbent (but without any substantial nickel or any other Group 6, 8, 9, or 10 metal other than iron). Other useful metal oxide sorbent materials include those disclosed in U.S. Pat. Nos. 5,866,503, 5,703,003, and 5,494,880, issued Feb. 2, 1999, Dec. 30, 1997, and Feb. 27, 1996, respectively, to Siriwardane. The latter are commercially available as RVS materials from SudChemie Inc.

Returning to FIG. 1, the sorbents fed into the desulfurization zone 10 via inlet pipe 34 are preferably substantially free from active hydrodesulfurization catalysts. The term "active hydrodesulfurization catalyst(s)" is used herein to mean nickel, cobalt, molybdenum, tungsten, and combinations of these metals when present in a state that is chemically active or activatable for hydrodesulfurization. Such metals are considered active or activatable for hydrodesulfurization, in a sulfided state, or in a form that is readily converted to the sulfided metal when exposed to a hydrocarbon feed containing hydrogen and sulfur contaminants at high temperature desulfurizing conditions. In particular, sulfides of nickel, cobalt, molybdenum, tungsten and combinations thereof, are well known by those skilled in the art to be the active catalytic components for hydrodesulfurization. It is likewise well known in the art that oxides of molybdenum, cobalt, nickel, and tungsten can be readily converted to the active sulfides by exposure to hydrogen and sulfur compounds in hydrocarbon feeds at the desulfurization conditions employed in this invention.

Each of the terms, "substantially free" and "substantial absence", as applied to active hydrodesulfurization catalysts, is used herein to mean that active hydrodesulfurization catalyst(s) are not present, in a form physically accessible to the hydrocarbon feed and in sufficient quantity, to promote substantial conversion of the organic sulfur components in the feedstock into $H_2S$ by reaction with hydrogen gas, under the desulfurization conditions employed in a process of the invention. In turn, saturation of desirable hydrocarbon olefins in the feed is substantially reduced or eliminated, even in the presence of small quantities of hydrogen, and even at high temperatures. Similarly the costs associated with hydrogen consumption can be greatly reduced or substantially eliminated.

Preferably, the sorbents used in the present invention contain less than about 1.0 wt. % nickel, cobalt, molybdenum, tungsten and/or combinations of these metals, calculated based on the weight of such metal(s), and on the total sorbent weight including the cracking catalyst support or component. More preferably, the sorbents used in the present invention contain less than about 0.5 wt. % nickel, cobalt, molybdenum, tungsten and/or combinations of these metals, calculated based on the weight of such metal(s), and on the total sorbent weight. Even more preferably the sorbents used in the present invention contain less than about 1.0 wt. % of Group 6 and/or Group 8, 9, and 10 metals (excluding iron), and most preferably the sorbents used in the present invention contain less than about 0.5 wt. % of Group 6 and/or Group 8, 9, and 10 metals (excluding iron), calculated based on the weight of such metal(s), and on the total sorbent weight including the cracking catalyst support or component.

Returning to FIG. 1, the sorbent added via inlet pipe 34 is transported upwardly through riser pipe 38 and separated via a cyclone separator 42. The separated sorbent is recovered via a standpipe 44 and a portion of the sorbent is passed via a pipe 46 to the regeneration zone 20 which preferably constitutes a riser pipe 50. An oxygen-containing regeneration gas 52, which is preferably ambient air, is added to the riser 50 via inlet pipe 54. In addition, fresh makeup sorbent 56 is added as necessary via inlet pipe 54. Further, the metal sulfide additives for enhancing or initiating regeneration, described in the aforementioned Turk et al. U.S. patent, can be advantageously added to the riser 50 via line 58 and inlet 54 in order to improve process economies in the regeneration zone 20 as described in greater detail in the aforementioned Turk et al. patent.

Preferably, the heat carried by the heated sorbent particles admitted to the riser 50 via pipe 46, and the heat carried by the oxygen in the oxygen-containing stream, are sufficient to establish conditions in the regeneration zone 20 for initiating regeneration of the sulfided active metal oxide sorbent and/or for initiating reaction of the metal sulfide additive, added via line 58, with oxygen in a highly exothermic combustion reaction to form a metal oxide and sulfur dioxide. The heat released by the metal sulfide additive can, in some cases, be used to initiate regeneration of the active metal oxide sulfur adsorbent at start-up of the process, or can be used as a supplemental heating source for maintaining the desired temperature in the regeneration zone 20.

The temperature in the regeneration zone during the regeneration reaction typically is within a range of from about the same temperature as the temperature in the desulfurization zone 10 up to a temperature of about 200° C.

higher than the temperature in zone 10, for example, a temperature of about 425° C. (800° F.) or higher under steady state conditions. The heat generated during removal of the sulfide contaminants from the active metal oxide sorbents advantageously supplies all or a portion of the heat necessary for vaporization of the hot feed gas stream 30.

In the regeneration zone 20, the oxygen containing regeneration gas reacts with the sulfur on the active metal oxide sorbent to produce sulfur oxides which are removed as a tail gas stream via line 60. Regenerated sorbent is separated via a cyclone separator 62 and passed via a standpipe 64 and inlet pipe 34 back to the desulfurization zone 10.

A desulfurized hydrocarbon fuel stream 70 is recovered from cyclone separator 42 and passed to a conventional separation zone 72 for separation of a recycle hydrogen stream 74 and a desulfurized hydrocarbon fuel stream 76.

The desulfurization process of the present invention can be used to treat naphtha and diesel streams having sulfur contents of from 150 ppmw to over 3,000 ppmw, while reducing the sulfur contaminants by virtually any preselected amount. As will be apparent to those skilled in the art, the percentage of sulfur reduction can be readily controlled by varying residence time and temperature in the desulfurization zone.

Advantageously, the process of the invention is conducted at conditions resulting in a sulfur content reduction of at least about 50% or more, preferably at least 80%, more preferably at least about 90%, even more preferably at least about 95%, based on the sulfur content, by weight, of the feedstock. In preferred embodiments of the invention, the sulfur contaminants can be reduced to levels below 20 ppmw, more preferably below 10 ppmw during a residence time preferably below about 20 seconds, more preferably below about 10 seconds. Moreover, such sulfur reductions are preferably achieved with an octane number loss, in the case of FCC naphtha of less than about 5, preferably less than about 2.

Figure 2:
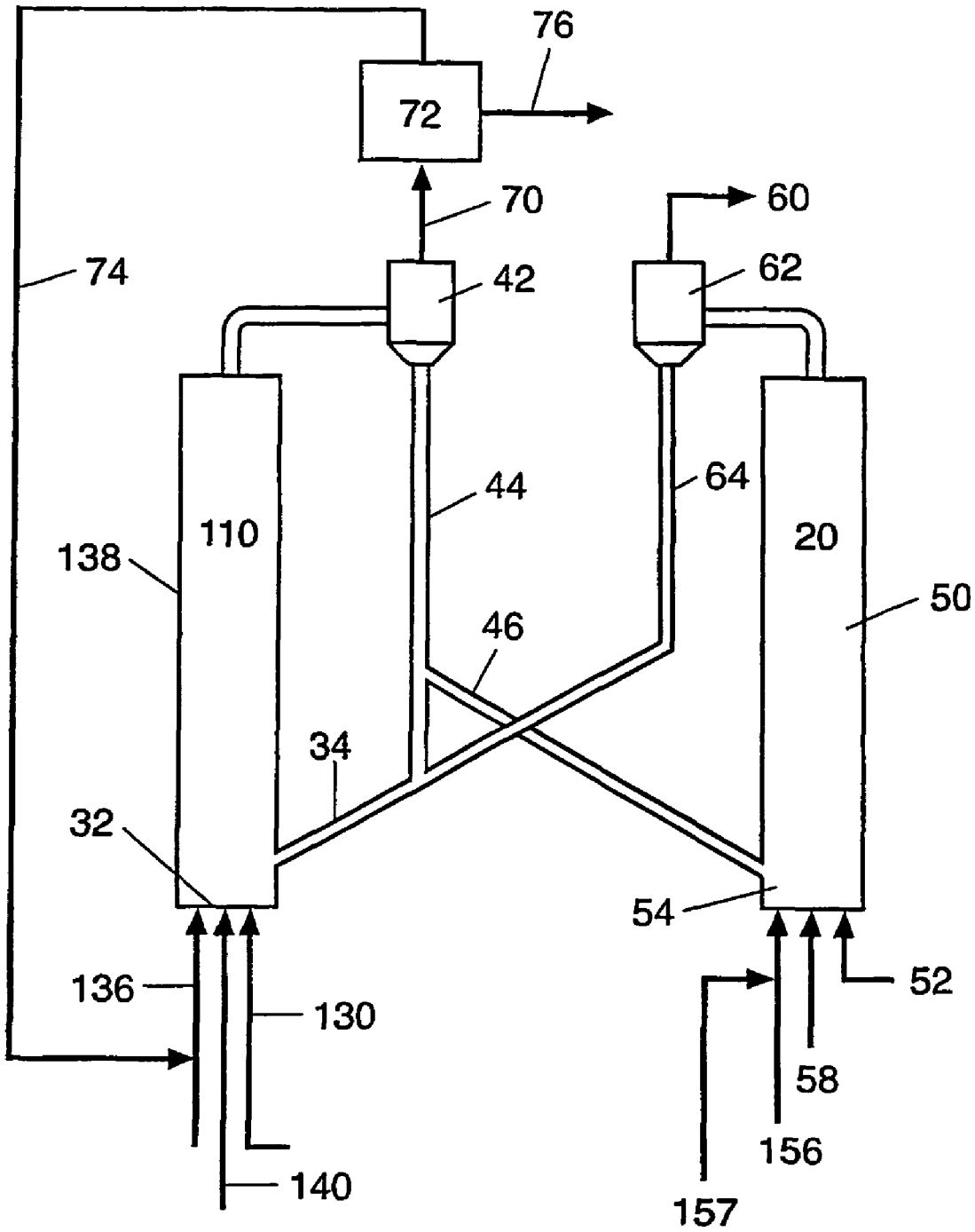
FIG. 2 is a schematic view illustrating an FCC desulfurization process in accordance with another preferred aspect of the present invention.

With reference now to FIG. 2, an FCC desulfurization process in accordance with another preferred aspect of the present invention is illustrated by a schematic view wherein certain of the drawing parts are labeled with the same numbers as in FIG. 1, and accordingly represent the same parts as the corresponding parts numbered the same in FIG. 1.

In particular, FIG. 2 illustrates a preferred process of the invention in which sulfur contaminants are removed from an vaporized sulfur-containing FCC feedstock 130 simultaneously with an otherwise conventional FCC process which is conducted in a conventional FCC riser reactor 110 under conventional temperature, pressure and residence times employed for FCC processes. A mixture of a conventional FCC catalyst with a regenerable sorbent comprising an active metal oxide sulfur sorbent supported on, or otherwise combined with a refractory inorganic oxide cracking catalyst, preferably comprising a metal substituent, is fed to the FCC reactor zone 110 via line 140. Although not specifically shown in FIG. 2, the FCC catalyst and the regenerable sorbent alternatively can be admitted to the FCC riser 138 via separate lines, or by mixing with the vaporized sulfur-containing FCC feedstock 130. According to this aspect of the invention, sulfur compounds initially present in the FCC feedstock, or generated during the FCC process, are selectively captured by the sorbent in the FCC riser. The sulfur-laden sorbent is then sent to the FCC regenerator 20 along with the carbon-laden FCC catalyst for regeneration by treatment with an oxygen-containing gas, typically air, which is also used to regenerate the FCC catalyst. During regeneration, sulfur carried by the sorbent is converted to a sulfur dioxide-containing gas stream 60 that can be treated for sulfur removal in a downstream process unit such as a sulfur dioxide scrubber (not shown).

The active metal oxide sulfur sorbent has sufficient sulfur-removal activity, and is added to the FCC reactor 110 in an amount sufficient to achieve removal of at least about 50 wt. % of sulfur contaminants which would otherwise be present in the FCC naphtha product, i.e., the FCC liquid product fraction having an FBP less than about 430° F. Advantageously, the active metal oxide sulfur sorbent is also active for removal of sulfur contaminants from heavier FCC product fractions and is added to the FCC reactor 110 in an amount sufficient to achieve removal of at least about 50 wt. % of sulfur contaminants which would otherwise be present in both of the FCC naphtha and LCO product fractions, i.e., the FCC liquid product fraction having an FBP of less than about 650° F. In currently preferred embodiments according to this aspect of the invention, the active metal oxide sulfur sorbent is added to the FCC catalyst in an amount of from about 1 to about 10 wt. %, based on the weight of the FCC catalyst.

In more preferred embodiments of this aspect of the invention, the active metal oxide sulfur sorbent has sufficient sulfur-removal activity, and is added to the FCC reactor 110 in an amount sufficient to achieve removal of at least about 50 wt. % of sulfur contaminants which would otherwise be present in the complete liquid product recovered from the FCC reactor. According to still other preferred embodiments, the active metal oxide sulfur sorbent is added to the FCC reactor 110 in an amount sufficient to achieve removal of at least about 75 wt. %, more preferably at least about 90 wt. % of sulfur contaminants which would otherwise be present in the naphtha product. In yet other preferred embodiments, the active metal oxide sulfur sorbent is added to the FCC reactor 110 in an amount sufficient to achieve removal of at least about 75 wt. %, more preferably at least about 90 wt. % of sulfur contaminants which would otherwise be present in both of the FCC naphtha and LCO product fractions.

It has been found that regenerable sorbent comprising an active metal oxide sulfur sorbent supported on, or otherwise combined with a refractory inorganic oxide cracking catalyst are capable of removing thiophenic sulfur compounds in presence of $H_2S$ and mercaptans. Thus, tests have shown that when a mixture of 2,000 ppmv of thiophene and 10,000 ppmv of methyl mercaptan was used to test the performance of one preferred sorbent (see Example 6), it was found that presence of 10,000 ppmv of mercaptan did not affect the activity of the sorbent for thiophene removal. Similar results were also observed when thiophene was mixed with $H_2S$. This is particularly important in a FCC reactor as about 40 to 50% of the sulfur in the feed to the FCC is converted into $H_2S$. It has further been found that various preferred sorbents can be successfully regenerated under the conditions used in a typical FCC regenerator without any degradation in catalytic activity. Since the preferred sorbents are extremely attrition-resistant, they can be used along with the FCC catalyst in a conventional FCC process without substantial attrition problems.

One of the added benefits of this aspect of the invention can be increased yield of naphtha and LCO fractions from a FCC system because of change in sulfur distribution. Currently, refiners typically use a FBP of 410 to 420° F. for naphtha from their FCC reactor because they want to limit the sulfur in naphtha, particularly the higher molecular weight sulfur compounds (such as alkyl dibenzothiophenes).

Removal of sulfur in the FCC riser itself, in accord with the present invention, can allow this restriction to be eased so that refiners can make premium products at much higher yields than they currently do.

Although the process shown in FIG. 2 achieves desulfurization of an FCC hydrocarbon feed simultaneously with the FCC process, the desulfurization process illustrated in FIG. 2 can alternatively be achieved separately from the FCC process by treating the FCC hydrocarbon feed in a conventional FCC unit, operated at conventional FCC conditions, and positioned upstream of the FCC processing zone.

The following examples illustrate the use of various sorbent compositions for removal of organic sulfur compounds from various simulated syngas and hydrocarbon feedstocks.

EXAMPLE 1

A zinc titanate aluminate sorbent prepared according to Example 8 of PCT Application WO 99/42201 A1, published Aug. 26, 1999, having a weight of about 200 g was loaded into a 2 inch ID quartz reactor. This reactor was sealed in a stainless steel pressure shell. The system was pressurized to 50 psig and heated to 1000° F. in 4 SLPM (standard liters per minute) of nitrogen. The reactor effluent was used to continuously purge a sample loop for a Varian 3300 Gas Chromatograph fitted with a Sievers Model 355 sulfur chemiluminescence detector capable of detecting below 200 ppbv (parts per billion, volume) of sulfur.

The test was started by adjusting the flow to the reactor to 2 SLPM of hydrogen and 2 SLPM of a nitrogen mixture containing 200 ppmv (parts per million volume) each of ethyl-, propyl-, and butyl-mercaptan. At this time, HP ChemStation software was used to start a sequence designed to sample the reactor effluent at intervals of about 6 minutes. After 120 minutes, the flow was adjusted to have 0.4 SLPM of hydrogen and 3.6 SLPM of the nitrogen and mercaptan mixture. At a total run time of 240 minutes the flow was changed to 0.8 SLPM of 10 vol % $H_2S$ in hydrogen and 3.2 SLPM of nitrogen. When the level of $H_2S$ in the reactor effluent reached 100 ppmv, the sulfidation was terminated.

While purging the sulfidation gases of the reactor for about 30 minutes with 4 SLPM nitrogen, the sorbent was heated to 1150° F. After the reactor had been purged and the temperature had stabilized at the new temperature, the sorbent was regenerated with 4 SLPM of air. The regeneration was monitored by the $SO_2$ and $O_2$ leak in the reactor effluent. When the $O_2$ level had increased above 5 vol % and the $SO_2$ concentration had dropped below 2,000 ppmv (parts per million, volume), the regeneration was stopped.

In preparation for the next sulfidation, the sorbent bed was cooled to 1000° F. Sulfidation was started with a mixture of 3.6 SLPM of hydrogen, 0.2 SLPM of 1,960 ppmv thiophene in nitrogen and 0.25 SLPM of nitrogen. At the start of sulfidation, the HP ChemStation software sequence analyzing the reactor effluent every 6 minutes was also started. The flows were changed to 3.6 SLPM of hydrogen, 1 SLPM of the 1,960 ppmv thiophene in nitrogen mixture and 0.25 SLPM of nitrogen after 120 min. These flow conditions were maintained for another 120 minutes. The next set of flow conditions were 0.4 SLPM of 10 vol % $H_2S$ in hydrogen, 3.6 SLPM of hydrogen and 0.25 SLPM of nitrogen. These conditions were maintained until the $H_2S$ concentration in the effluent exceeded 100 ppmv.

For regeneration, the sorbent bed was heated to 1150° F. The regeneration was started with 4 SLPM of air. Regeneration was stopped when the effluent $SO_2$ concentration dropped below 2,000 ppmv and the effluent $O_2$ concentration increased above 5 vol %.

For the third sulfidation, the temperature in the sorbent bed was dropped to 1000° F. For the first 120 minutes of sulfidation, the flows were 3.6 SLPM of hydrogen, 0.2 SLPM of 945 ppmv 2-ethyl thiophene in nitrogen and 0.3 SLPM of nitrogen. After 120 minutes, the flows were changed to 3.6 SLPM of hydrogen, 1.0 SLPM of 945-ppmv thiophene in nitrogen, and 0.3 SLPM of nitrogen. The sulfidation and, consequently, the test were then terminated. The comparison of the steady state feed and effluent concentration for the various sulfur compounds (mercaptans, thiophene and ethyl thiophene) are listed in Table 1.

TABLE 1

Comparison Of The Concentration Of The Sulfur Contaminant In The Reactor Feed And Effluent With Zinc Titanate Aluminate Sorbent

| Compound | Concentration (ppmv) Feed | Effluent |
|---|---|---|
| Mercaptan (Ethyl-, propyl- and butyl-) | 300 | 0.5 |
| Mercaptan (Ethyl-, propyl- and butyl-) | 540 | 1 |
| Thiophene | 100 | 1 |
| Thiophene | 400 | 5 |
| 2-Ethylthiophene | 60 | 0.5 |
| 2-Ethylthiophene | 200 | 2 |

EXAMPLE 2

The following testing sequence was used to screen the following sorbent materials (1) the zinc titanate aluminate of Example 1, (2) a zinc aluminate (prepared as set forth below), (3) alumina (commercially available), (4) zinc titanate, (5) a physical mixture of zinc titanate and alumina, (6) a physical mixture of zinc aluminate and zinc titanate, (7) a commercial, stabilized zinc oxide guard bed material, G72D, commercially available from Sud-Chemie Inc, and (8) ECAT, a silica based commercial FCC catalyst. The test began by loading 50 g of each sample into an 1 inch ID quartz reactor. The reactor was placed in a furnace with temperature control based on the temperature at the center of the sorbent bed. The quartz reactor was fitted with two feed inlets, a thermocouple well and effluent side arm. The reactor effluent was setup to continuously feed the sample loop of a Hewlett Packard (HP) 6890 GC fitted with a J&W GS GasPro column and a Sievers Model 355 sulfur chemiluminescence detector. This detector can easily detect sulfur concentrations to below 200 ppbv.

In preparation for the run, the sorbent bed was heated to 800° F. in a nitrogen flow of approximately 500 sccm. The test was started by introducing into the reactor a mixture of 2,100 ppmv thiophene and nitrogen at 50 sccm (standard cubic centimeters per minute) with 400 sccm of nitrogen. HP ChemStations software was used to sample the reactor effluent periodically. The reactor effluent was monitored until two to three sequential results indicated steady state operation had been achieved. This typically took between 40 to 60 minutes. At this point the reactor system was bypassed and the reactor feed was fed directly to the GC system for analysis. As with the reactor effluent, the reactor feed was analyzed until several sequential results indicated the sulfur concentrations were consistent. The results from these screening tests are shown in Table 2.

The zinc aluminate sample used in these tests was prepared by mixing 66.9 g of alumina (Engelhard) and 53.4 g of zinc oxide (Aesar) in 300 ml of deionized (DI) water. This slurry was gently heated with continuous stirring for 1 hour. The slurry was dried at 120° C. overnight and calcined at 800° C. for 6 hours.

The effect of hydrogen addition was demonstrated in repeat test for alumina. During this test, the flows were set to 450 sccm of hydrogen and 50 sccm of a 2,100 ppmv thiophene in nitrogen mixture. The results for both the test with hydrogen and without hydrogen can be seen in Table 2.

TABLE 2

Comparison of Thiophene Concentration in the Reactor Feed and Effluent for Catalyst/Sorbent Screening Test

| | Feed Gas Composition | | | Effluent |
|---|---|---|---|---|
| Material | $N_2$ (Vol %) | $H_2$ (vol %) | Thiophene (ppmv) | Thiophene (ppmv) |
| Zinc titanate | Balance | | 137 | 114 |
| Zinc aluminate | Balance | | 205 | 0.09 |
| Alumina | Balance | | 238 | 23 |
| Alumina | Balance | 90.0 | 146 | 0.148 |
| Zinc titanate (40 wt %) and Zinc aluminate (60 wt %) | Balance | | 215 | 0.07 |
| Zinc titanate (40 wt %) and alumina (60 wt %) | Balance | | 195 | 82 |
| Zinc titanate aluminate | Balance | | 132 | 0.115 |
| ECAT | Balance | | 919 | 600 |
| G72D (zinc oxide) | Balance | | 133 | 0.78 |

As can be seen in Table 2, the zinc aluminate was effective for removal of the cyclic sulfur compositions with and without added or reacted zinc titanate. Moreover, the zinc aluminate was more effective without any hydrogen addition in removing the sulfur compounds than alumina with hydrogen. The zinc titanate aluminate was similarly effective.

EXAMPLE 3

This example used the same microreactor system that was used in Example 2. An isooctane sample spiked with various sulfur compounds was used to mimic FCC naphtha (shown in Table 3). Tests were conducted with this mixture to determine the effectiveness of the zinc titanate aluminate sorbent used in Example 1 at 1,000° F. with and without $H_2$. The results are shown in Table 3.

TABLE 3

Removal Of Various Sulfur Compounds From A Simulated Isooctane Sample Using Zinc Titanate Aluminate Sorbent With And Without Hydrogen

| | | Product (ppmw) | |
|---|---|---|---|
| Sulfur Compound | Feed (ppmw) | Test 1 Without $H_2$ | Test 2 With $H_2$ |
| Ethyl Mercaptan | 159.8 | 0.0 | 0.0 |
| Carbon Disulfide | 217.7 | 4.7 | 0.0 |
| Isopropyl Mercaptan | 103.0 | 0.0 | 0.0 |
| Thiophene | 88.5 | 46.6 | 33.6 |
| Diethyl Sulfide | 74.1 | 4.3 | 0.0 |
| 2-Ethyl Thiophene | 62.0 | 54.7 | 43.6 |
| Diethyl Disulfide | 105.1 | 6.6 | 0.8 |
| Benzothiophene | 39.8 | 89.8 | 58.3 |
| Dibenzothiophene | 27.7 | 2.9 | 13.3 |
| TOTAL | 877.8 | 209.6 | 149.6 |
| % Removal | | 76.1 | 82.9 |

Although not shown in Table 3, in each case the effluent was monitored for $H_2S$, and no traces were found in any of the tests. As seen in Table 3, even though no hydrodesulfurization catalyst was used in any of these tests, addition of $H_2$ improved the extent of desulfurization from 76.1 to 82.9 percent, with significant increase in removal of benzothiophene and dibenzothiophene. Although not fully understood, this is believed due to the enhanced stabilization of hydrocarbon radicals resulting from ring cracking, which in turn, is believed to decrease or minimize deactivation of the sorbent, e.g., by coking. Further, it is to be noted that the sorbent has a surface area of about 5 $m^2/g$, and that higher surface areas should improve the desulfurization efficiency.

EXAMPLE 4

Example 3 was repeated except that the reaction temperature was lowered to 800° F. and the zinc titanate aluminate sorbent was modified to include a copper promoter using the following procedure.

100 g of the zinc titanate aluminate sorbent powder of Example 3 was dried at 120° C. for one hour and then cooled in a desiccator.

To 35 mL D.I. $H_2O$ in a 100 ml beaker was added 28.8 g of cupric nitrate (obtained from Sigma Chemical). 5.5 mL of the $Cu(NO_3)_2$ solution was applied to the zinc titanate aluminate sorbent powder drop by drop while stirring with a Teflon rod. The resultant powder was calcined at 200° C. (5° C./min) for 2 hours and cooled in a desiccator. The impregnation and calcining steps were repeated to achieve a second impregnation. The twice impregnated sorbent was dried at 120° C. overnight, and then calcined at 280° C. (5° C./min) for 4 hours.

The results of testing of this Cu-impregnated sorbent are shown in Table 4. As can be seen from these results, the copper promoter allowed the same sulfur removal efficiency at 800° F. as was achieved with unpromoted zinc titanate aluminate at 1000° F.

TABLE 4

Removal Of Various Sulfur Compounds With And Without The Addition Of The Copper Promoter To The Zinc Titanate Aluminate Sorbent

| | | Product (ppmw) | |
|---|---|---|---|
| Sulfur Compound | Feed (ppmw) | Test 1 1,000° F. (original sorbent) | Test 2 800° F. (modified sorbent) |
| Ethyl Mercaptan | 159.8 | 0.0 | 0.0 |
| Carbon Disulfide | 217.7 | 0.0 | 0.0 |
| Isopropyl Mercaptan | 103.0 | 0.0 | 0.0 |
| Thiophene | 88.5 | 33.6 | 54.6 |
| Diethyl Sulfide | 74.1 | 0.0 | 175.8 |
| 2-Ethyl Thiophene | 62.0 | 43.6 | 0.0 |

TABLE 4-continued

Removal Of Various Sulfur Compounds With And Without The Addition Of The Copper Promoter To The Zinc Titanate Aluminate Sorbent

| Sulfur Compound | Feed (ppmw) | Product (ppmw) Test 1 1,000° F. (original sorbent) | Test 2 800° F. (modified sorbent) |
|---|---|---|---|
| Diethyl Disulfide | 105.1 | 0.8 | 0.0 |
| Benzothiophene | 39.8 | 58.3 | 0.0 |
| Dibenzothiophene | 27.7 | 13.3 | 0.0 |
| TOTAL | 877.8 | 149.6 | 280.4 |
| % Removal | | 82.9 | 73.7 |

EXAMPLE 5

The following testing sequence was used to screen the following sorbent materials: (1) Iron Oxide supported on the Zinc Titanate Aluminate of Example 1 (prepared as described below); (2) Zinc Aluminate prepared as described in Example 2; (3) Copper Oxide supported on Zinc Aluminate, (prepared as described below); and, (4) Iron Oxide supported on Zinc Aluminate, (prepared as described below).

Preparation of sorbent (1), Iron Oxide supported on Zinc Titanate Aluminate. A 100 g sample of the zinc titanate aluminate from Example 1 was dried at 120° C. for an hour and allowed to cool in a desiccator. A solution of iron nitrate was prepared by dissolving 38.3 g of $Fe(NO_3)_3.9H_2O$ in 20 ml of deionized (DI) water. A total of 15 ml of this iron nitrate solution was added to the zinc titanate aluminate drop by drop while continuously mixing the zinc titanate aluminate. The resulting powder was calcined at 200° C. for 2 hours and cooled in a desiccator. A second sample of iron nitrate solution was made and impregnated on the previously impregnated zinc titanate aluminate in the manner described above. The final impregnated sample was dried at 120° C. overnight and calcined at 280° C. for 4 hours.

Preparation of sorbent (3), Copper Oxide supported on Zinc Aluminate. A 100 g sample of the zinc aluminate from Example 2 was treated with a copper impregnating solution prepared by dissolving 44.9 g of $Cu(NO_3)_2$ in 55 ml of DI water. During the first impregnation 26 ml of the copper impregnating solution was added to the zinc aluminate drop by drop as the zinc aluminate was vigorously stirred. The sample was then dried at 200° C. for 2 hours and cooled in a desiccator. After cooling, the sample was impregnated with another 26 ml of the copper impregnating solution in the manner described above. The sample was dried at 120° C. and calcined for 4 hours at 280° C.

Preparation of sorbent (4) Iron Oxide supported on Zinc Aluminate. An iron impregnated zinc aluminate sample was prepared using the same procedure as used for the copper impregnated zinc aluminate of sorbent (3) above. The iron impregnating solution was prepared by dissolving 76.2 g of $Fe(NO_3)_3.9H_2O$ in 40 ml of DI water. The twice impregnated sample was dried and calcined in a like manner as sorbent (3) above.

The test began by loading 50 g of each sample into a 1-inch ID quartz reactor. The reactor was placed in a furnace with temperature control based on the temperature at the center of the sorbent bed. The quartz reactor was fitted with two feed inlets, a thermocouple well, and an effluent side arm. The reactor effluent was setup to continuously feed the sample loop of a HP 6890 GC fitted with a J&W GC GasPro column and a Sievers Model 355 sulfur chemiluminescence detector. This detector can easily detect sulfur down to 50 ppbv.

In preparation for each test, the sorbent bed was heated to 800° F. in a nitrogen flow of approximately 500 sccm. The test was started by introducing into the reactor a mixture containing 200 ppmv methylmercaptan, and 200 ppmv thiophene with the balance being nitrogen. HP Chemstations software was used to sample the reactor effluent periodically. The reactor effluent was monitored until two or three sequential results indicated steady state operation had been achieved. This typically took between 40 to 60 minutes. At this point the reactor system was bypassed and the reactor feed was feed directly to the GC system for analysis. As with the reactor effluent, the reactor feed was analyzed until several sequential results indicated the sulfur concentrations were consistent. The results from these screening tests are shown in Table 5.

TABLE 5

Comparison of Reactor Feed and Effluent For Second Sorbent Screening Test

| Sorbent Material | Methyl Mercaptan (ppmv) Feed | Methyl Mercaptan (ppmv) Effluent | Thiophene (ppmv) Feed | Thiophene (ppmv) Effluent |
|---|---|---|---|---|
| Iron Oxide/Zinc Titanate Aluminate | 186 | N.D.* | 274 | N.D. |
| Zinc aluminate | 191 | N.D. | 281 | 0.7 |
| Copper Oxide/Zinc Aluminate | 191 | N.D. | 290 | N.D. |
| Iron Oxide/Zinc Aluminate | 191 | N.D. | 291 | 0.2 |

*Not Detected

EXAMPLE 6

A 50 g sample of the Zinc Aluminate-supported Iron Oxide sorbent prepared as described in Example 5 was loaded in the 1-inch ID quartz reactor. The furnace heating was controlled with a thermocouple in the sorbent bed approximately 1-in from the quartz frit supporting the sorbent bed. After installing the quartz reactor and connecting the feed and effluent lines, the sorbent bed was heated to 800° F. in a nitrogen flow of approximately 500 sccm. When the sorbent bed temperature was 800° F., the sorbent was exposed to 500 sccm of air for 60 min. The reactor was purged with nitrogen at 500 sccm for 15 min to remove any traces of oxygen. The sample was then exposed to a mixture with 1920 ppmv of thiophene and 9940 ppmv methyl mercaptan in nitrogen at 500 sccm. HP Chemstations software was used to periodically record the sulfur content of the reactor effluent as determined by an HP 6890 GC equipped with a J&W GasPro column and Sievers Model 355 sulfur chemiluminescence detector. Exposure of the sorbent sample continued until the thiophene concentration in the effluent increased to 100 ppmv. At this point no methyl mercaptan was detected in the effluent. The total time of sorbent exposure prior to breakthrough (thiophene effluent concentration >100 ppmv) was 5 hours. This corresponds to a sulfur weight loading of 4.4 wt % for the methtyl mercaptan and 0.7 wt % for the thiophene.

The sorbent sample was then regenerated with 500 sccm of air at 800° F. for 60 min. The sorbent was exposed to the same methyl mercaptan, thiophene and nitrogen mixture at the same conditions as during the first exposure to breakthrough. The total exposure time prior to breakthrough for this second exposure was 4 hours. Once again the thiophene effluent concentration was observed to increase to 100 ppmv without any methyl mercaptan being detected. The sulfur loadings were 0.84 wt % for thiophene and 3.6 wt % for methyl mercaptan.

The sorbent was again regenerated with 500 sccm of air at 800° F. for 120 min. After purging of the oxygen by nitrogen, the sorbent was exposed to a 1970 ppmv thiophene in nitrogen mixture at 500 sccm at 800° F. The effluent sulfur content was monitored as in previous exposure cycles. The sorbent was exposed to this mixture for 6 hours. The test had to be terminated at this point because the tank with the thiophene/nitrogen mixture was empty. The effluent thiophene concentration at this time was 56 ppmv. Thus, breakthrough had not been reached. The sulfur loading for this exposure test was 1 wt % for thiophene.

Many modifications and other embodiments of the invention will come to mind to one skilled in the art to which this invention pertains having the benefit of the teachings presented in the foregoing descriptions and the associated drawing. Therefore, it is to be understood that the invention is not to be limited to the specific embodiments disclosed and that modifications and other embodiments are intended to be included within the spirit and scope of the appended claims. Although specific terms are employed herein, they are used in a generic and descriptive sense only and not for purposes of limitation.

That which is claimed:

1. A process for removing aromatic organic sulfur compounds from a normally liquid hydrocarbon fuel or fuel component feedstock having a sulfur content of at least about 150 ppmw comprising the steps:

contacting the feedstock in the substantial absence of a hydrodesulfurization catalyst, with a regenerable sorbent material comprising at least one active metal oxide sorbent capable of selectively removing sulfur compounds present in the hydrocarbon feedstock and a refractory inorganic oxide cracking catalyst capable of cracking cyclic organic sulfur compounds, wherein said refractory inorganic oxide cracking catalyst comprises zinc aluminate;

recovering a hydrocarbon product having a sulfur content of about 50% or less than the sulfur content of the feedstock;

regenerating at least a portion of said regenerable sorbent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step prior to reuse in said contacting step.

2. The process of claim 1, wherein in said active metal oxide sorbent capable of selectively removing sulfur compounds present in the hydrocarbon feedstock, said metal is the same metal as the metal of said metal-substituted refractory inorganic oxide cracking catalyst sorbent.

3. The process of claim 1, wherein said contacting step is conducted at a temperature of at least about 300° C.

4. The process of claim 1, wherein said hydrocarbon feedstock comprises at least about 100 ppmw of cyclic organic sulfur compounds.

5. The process of claim 4, wherein said wherein said hydrocarbon feedstock comprises a sulfur content of at least about 300 ppmw.

6. The process of claim 1 wherein said contacting step is conducted such that said feedstock is contacted simultaneously with said sorbent and said refractory inorganic oxide cracking catalyst.

7. The process of claim 1, wherein said hydrocarbon feedstock comprises FCC naphtha.

8. The process of claim 1, wherein said hydrocarbon feedstock consists essentially of FCC naphtha.

9. The process of claim 7, wherein said hydrocarbon product recovered in said recovering step has a sulfur content of less than about 10 ppmw.

10. The process of claim 1, wherein said hydrocarbon feedstock comprises diesel fuel or a precursor or component thereof.

11. The process of claim 1, wherein said hydrocarbon feedstock comprises coker naphtha, thermally cracked naphtha, light cycle oil, or a straight-run diesel fraction.

12. The process of claim 1, wherein said metal oxide sorbent comprises zinc oxide.

13. The process of claim 1, wherein said refractory inorganic oxide cracking catalyst further comprises alumina.

14. The process of claim 1, wherein said contacting step is carried out in a transport bed reactor with a vapor residence time of less than about 20 seconds.

15. A process for removing cyclic and polycyclic organic sulfur compounds from a normally liquid hydrocarbon feedstock comprising the steps:

contacting the feedstock in the substantial absence of a hydrodesulfurization catalyst, with a sorbent comprising a metal-substituted refractory inorganic oxide cracking catalyst capable of cracking cyclic organic sulfur compounds, said metal being selected from the group consisting of metals which are capable in their oxide form, of adsorption of reduced sulfur compounds by conversion of the metal oxide to a metal sulfide, wherein said refractory inorganic oxide cracking catalyst comprises zinc aluminate; and recovering a hydrocarbon product having a cyclic and polycyclic organic sulfur content at least about 25% less than the cyclic and polycyclic organic sulfur content of the feedstock, based on the sulfur weight of said cyclic and polycyclic organic sulfur compounds in said feedstock and the sulfur weight of cyclic and polycyclic organic sulfur compounds in said product;

regenerating at least a portion of said sorbent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step prior to reuse in said contacting step.

16. The process of claim 15, wherein said sorbent further comprises an active metal oxide sorbent capable of selectively removing sulfur compounds present in the hydrocarbon feedstock, the metal of said metal oxide being the same metal as the metal of said metal-substituted refractory inorganic oxide cracking catalyst sorbent.

17. The process of claim 15, wherein said contacting step is conducted at a temperature of at least about 300° C.

18. The process of claim 15, wherein said hydrocarbon feedstock comprises at least about 150 ppmw of sulfur compounds.

19. The process of claim 15, wherein said product has a sulfur content at least about 50% less than the sulfur content of the feedstock.

20. The process of claim 19, wherein said hydrocarbon feedstock comprises FCC naphtha.

21. The process of claim 15, wherein said hydrocarbon feedstock comprises FCC naphtha.

22. The process of claim 19, wherein said hydrocarbon feedstock consists essentially of FCC naphtha.

23. The process of claim 15, wherein said hydrocarbon feedstock consists essentially of FCC naphtha.

24. The process of claim 20, wherein said hydrocarbon product has a sulfur content of less than about 10 ppmw.

25. The process of claim 15, wherein said hydrocarbon feedstock comprises diesel fuel or a precursor or component thereof.

26. The process of claim 15, wherein said hydrocarbon feedstock consists essentially of diesel fuel or a precursor or component thereof.

27. The process of claim 15, wherein said hydrocarbon feedstock comprises coker naphtha, thermally cracked naphtha, light cycle oil, or a straight-run diesel fraction.

28. The process of claim 15, wherein said hydrocarbon feedstock consists essentially of coker naphtha, thermally cracked naphtha, light cycle oil, or a straight-run diesel fraction.

29. The process of claim 15, wherein said metal-substituted refractory inorganic oxide cracking catalyst further comprises alumina.

30. The process of claim 16, wherein said metal-substituted refractory inorganic oxide cracking catalyst further comprises alumina.

31. The process of claim 16, wherein said active metal oxide sorbent comprises zinc oxide.

32. The process of claim 24, wherein said active metal oxide sorbent comprises zinc titanate.

33. The process of claim 15, wherein said active metal oxide sorbent comprises an iron oxide.

34. The process of claim 15, wherein said contacting step is carried out in a transport bed reactor with a vapor residence time of less than about 20 seconds.

35. The process of claim 15, wherein said contacting step is carried out in a bubbling bed reactor.

36. The process of claim 16, wherein said contacting step is carried out in a transport bed reactor with a vapor residence time of less than about 20 seconds.

37. The process of claim 16, wherein said contacting step is carried out in a bubbling bed reactor.

38. The process of claim 20, wherein said contacting step is carried out in a transport bed reactor with a vapor residence time of less than about 20 seconds.

39. The process of claim 20, wherein said contacting step is carried out in a bubbling bed reactor.

40. The process of claim 25, wherein said contacting step is carried out in a transport bed reactor with a vapor residence time of less than about 20 seconds.

41. The process of claim 25, wherein said contacting step is carried out in a bubbling bed reactor.

42. A process for removing cyclic and polycyclic organic sulfur compounds from a normally liquid hydrocarbon feedstock comprising the steps:

contacting the feedstock in the substantial absence of a hydrodesulfurization catalyst, with a sorbent comprising at least one active metal oxide sorbent capable of selectively removing sulfur compounds present in the hydrocarbon feedstock and a refractory inorganic oxide cracking catalyst capable of cracking cyclic organic sulfur compounds1 wherein said refractory inorganic oxide cracking catalyst comprises zinc aluminate; and recovering a hydrocarbon product having a cyclic and polycyclic organic sulfur content at least about 25% less than the cyclic and polycyclic organic sulfur content of the feedstock, based on the sulfur weight of said cyclic and polycyclic organic sulfur compounds in said feedstock and the sulfur weight of cyclic and polycyclic organic sulfur compounds in said product;

regenerating at least a portion of said sorbent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step prior to reuse in said contacting step.

43. The process of claim 42, wherein said contacting step is conducted at a temperature of at least about 300° C.

44. The process of claim 42, wherein said hydrocarbon feedstock comprises at least about 150 ppmw of sulfur compounds.

45. The process of claim 42, wherein said product has a sulfur content at least about 50% less than the sulfur content of the feedstock.

46. The process of claim 45, wherein said hydrocarbon feedstock comprises FCC naphtha.

47. The process of claim 42, wherein said hydrocarbon feedstock comprises hydrotreated FCC naphtha.

48. The process of claim 42, wherein said hydrocarbon feedstock comprises hydrotreated diesel fuel or a hydrotreated precursor or hydrotreated component thereof.

49. The process of claim 42, wherein said hydrocarbon feedstock consists essentially of a hydrotreated gasoline or diesel fuel or a hydrotreated precursor or hydrotreated component of gasoline or diesel fuel.

50. The process of claim 49, wherein said hydrocarbon product has a sulfur content of less than about 10 ppmw.

51. The process of claim 42, wherein said hydrocarbon feedstock comprises diesel fuel or a precursor or component thereof.

52. The process of claim 42, wherein said hydrocarbon feedstock consists essentially of diesel fuel or a precursor or component thereof.

53. The process of claim 42, wherein said hydrocarbon feedstock comprises coker naphtha, thermally cracked naphtha, light cycle oil, or a straight-run diesel fraction.

54. The process of claim 45, wherein said hydrocarbon feedstock comprises coker naphtha, thermally cracked naphtha, light cycle oil, or a straight-run diesel fraction.

55. The process of claim 42, wherein said refractory inorganic oxide cracking catalyst further comprises alumina.

56. The process of claim 42, wherein said active metal oxide sorbent comprises zinc oxide.

57. The process of claim 42, wherein said active metal oxide sorbent comprises an iron oxide.

58. The process of claim 42, wherein said contacting step is carried out in a transport bed reactor with a vapor residence time of less than about 20 seconds.

59. The process of claim 42, wherein said contacting step is carried out in a bubbling bed reactor.

60. The process of claim 45, wherein said contacting step is carried out in a transport bed reactor with a vapor residence time of less than about 20 seconds.

61. The process of claim 45, wherein said contacting step is carried out in a bubbling bed reactor.

62. A process for removing aromatic organic sulfur compounds from a normally liquid hydrocarbon fuel or fuel component feedstock having a sulfur content of at least about 150 ppmw comprising the steps:

contacting the feedstock in a transport bed reactor during a vapor residence time of less than about 20 seconds, with a regenerable sorbent material comprising at least one active metal oxide sorbent capable of selectively removing sulfur compounds present in the hydrocarbon feedstock and a refractory inorganic oxide cracking catalyst capable of cracking cyclic organic sulfur compounds, said reactor being substantially free of hydrodesulfurization catalyst, wherein said refractory inorganic oxide cracking catalyst comprises zinc aluminate; and recovering a hydrocarbon product having a reduced sulfur content;

regenerating at least a portion of said regenerable sorbent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step prior to reuse in said contacting step.

63. The process of claim 62, wherein in said active metal oxide sorbent capable of selectively removing sulfur compounds present in the hydrocarbon feedstock, said metal is the same metal as the metal of said metal-substituted refractory inorganic oxide cracking catalyst sorbent.

64. The process of claim 62, wherein said contacting step is conducted at a temperature of at least about 300° C.

65. The process of claim 62, wherein said hydrocarbon feedstock comprises at least about 100 ppmw of cyclic and polycyclic organic sulfur compounds.

66. The process of claim 62, wherein said wherein said hydrocarbon feedstock comprises a sulfur content of at least about 300 ppmw.

67. The process of claim 62 wherein said contacting step is conducted such that said feedstock is contacted simultaneously with said sorbent and said refractory inorganic oxide cracking catalyst.

68. The process of claim 62, wherein said hydrocarbon feedstock comprises FCC naphtha.

69. The process of claim 62, wherein said hydrocarbon feedstock comprises diesel fuel or a precursor or component thereof.

70. The process of claim 62, wherein said hydrocarbon product recovered in said recovering step has a sulfur content of less than about 10 ppmw.

71. The process of claim 62, wherein said metal oxide sorbent comprises zinc oxide.

72. The process of claim 62, wherein said refractory inorganic oxide cracking catalyst further comprises alumina.

73. The process of claim 62, wherein said metal oxide sorbent comprises an iron oxide.

74. A process for removing cyclic and polycyclic organic sulfur compounds from a normally liquid hydrocarbon feedstock having a sulfur content comprising at least about 100 ppmw of cyclic and polycyclic organic sulfur compounds comprising the steps:

contacting the feedstock in a transport bed reactor during a vapor residence time of less than about 20 seconds with a sorbent comprising a metal-substituted refractory inorganic oxide cracking catalyst capable of cracking cyclic organic sulfur compounds, said metal being selected from the group consisting of metals which are capable in their oxide form, of adsorption of reduced sulfur compounds by conversion of the metal oxide to a metal sulfide, wherein said refractory inorganic oxide cracking catalyst comprises zinc aluminate, said reactor being substantially free of hydrodesulfurization catalyst; and recovering a hydrocarbon product having a cyclic and polycyclic organic sulfur content at least about 25% less than the cyclic and polycyclic organic sulfur content of the feedstock, based on the sulfur weight of said cyclic and polycyclic organic sulfur compounds in said feedstock and the sulfur weight of cyclic and polycyclic organic sulfur compounds in said product;

regenerating at least a portion of said sorb ent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step prior to reuse in said contacting step.

75. The process of claim 74, wherein said sorbent further comprises an active metal oxide sorbent capable of selectively removing sulfur compounds present in the hydrocarbon feedstock, said metal being the same metal as the metal of said metal-substituted refractory inorganic oxide cracking catalyst sorbent.

76. The process of claim 74, wherein said contacting step is conducted at a temperature of at least about 300° C.

77. The process of claim 74, wherein said hydrocarbon feedstock comprises at least about 300 ppmw of sulfur compounds.

78. The process of claim 74, wherein said product has a sulfur content at least about 50% less than the sulfur content of the feedstock.

79. The process of claim 74, wherein said hydrocarbon feedstock comprises an FCC naphtha.

80. The process of claim 74, wherein said hydrocarbon feedstock comprises diesel fuel or a precursor or component thereof.

81. The process of claim 74, wherein said hydrocarbon product recovered in said recovering step has a sulfur content of less than about 10 ppmw.

82. The process of claim 75, wherein said metal oxide sorbent comprises zinc oxide.

83. The process of claim 74, wherein said metal-substituted refractory inorganic oxide cracking catalyst further comprises alumina.

84. A process for removing organic sulfur compounds from an FCC hydrocarbon stream during an FCC process comprising the steps:

contacting an FCC hydrocarbon feedstock in a reaction zone under FCC reaction conditions with an FCC catalyst and a regenerable sorbent comprising an active metal oxide sulfur sorbent supported on or otherwise combined with a refractory inorganic oxide cracking catalyst, said metal being selected from the group consisting of metals which are capable in their oxide form, of adsorption of reduced sulfur compounds by conversion of the metal oxide to a metal sulfide, wherein said refractory inorganic oxide cracking catalyst comprises zinc aluminate; and recovering a cracked hydrocarbon product comprising FCC naphtha having a sulfur content at least about 50 wt. % less than the sulfur content of said FCC naphtha when said FCC process is conducted without said regenerable sorbent under substantially identical FCC reaction conditions;

regenerating at least a portion of said regenerable sorbent with an oxidizing gas under conditions sufficient to convert metal sulfide into said metal oxide sorbent and thereby provide regenerated sorbent, and recycling at least a portion of said regenerated sorbent to said contacting step without submitting said regenerated sorbent to a reduction step pnor to reuse in said contacting step.

85. The process of claim 84 wherein said cracked hydrocarbon product recovered in said recovering step comprises FCC naphtha and light cycle oil fractions having a sulfur content at least about 50 wt. % less than the sulfur content of said FCC naphtha and light cycle oil fractions when said FCC process is conducted without said regenerable sorbent under substantially identical FCC reaction conditions.

86. The process of claim 84 wherein said cracked hydrocarbon product recovered in said recovering step comprises FCC naphtha having a sulfur content at least about 75 wt. % less than the sulfur content of said FCC naphtha when said FCC process is conducted without said regenerable sorbent under substantially identical FCC reaction conditions.

87. The process of claim 84 wherein said cracked hydrocarbon product recovered in said recovering step comprises FCC naphtha having a sulfur content at least about 90 wt. % less than the sulfur content of said FCC naphtha when said FCC process is conducted without said regenerable sorbent under substantially identical FCC reaction conditions.

88. The process of claim 84 wherein said cracked hydrocarbon product recovered in said recovering step has a sulfur content at least about 50 wt. % less than the sulfur content of said cracked hydrocarbon product when said FCC process is conducted without said regenerable sorbent under substantially identical FCC reaction conditions.

89. The process of claim 84 wherein said cracked hydrocarbon product recovered in said recovering step comprises FCC naphtha and light cycle oil fractions having a sulfur content at least about 75 wt. % less than the sulfur content of said FCC naphtha and light cycle oil fractions when said FCC process is conducted without said regenerable sorbent under substantially identical FCC reaction conditions.

90. The process of claim 84 wherein said cracked hydrocarbon product recovered in said recovering step comprises FCC naphtha and light cycle oil fractions having a sulfur content at least about 90 wt. % less than the sulfur content of said FCC naphtha and light cycle oil fractions when said FCC process is conducted without said regenerable sorbent under substantially identical FCC reaction conditions.

91. The process of claim 84 wherein regenerable sorbent is present in said reaction zone an amount of from about 1 to about 10 wt %, based on the weight of the FCC catalyst present in said reaction zone.

92. The process of claim 84, wherein said refractory inorganic oxide cracking catalyst consists essentially of zinc aluminate.

93. The process of claim 92, wherein said metal of said active metal oxide sulfur sorbent is zinc.

94. The process of claim 84, wherein said metal-substituted refractory inorganic oxide cracking catalyst further comprises alumina.

95. The process of claim 84, wherein said active metal oxide sulfur sorbent comprises zinc oxide.

96. The process of claim 84, wherein said active metal oxide sulfur sorbent comprises zinc titanate.

* * * * *

UNITED STATES PATENT AND TRADEMARK OFFICE

CERTIFICATE OF CORRECTION

PATENT NO. : 7,291,259 B2
APPLICATION NO. : 10/363677
DATED : November 6, 2007
INVENTOR(S) : Raghubir P. Gupta et al.

It is certified that error appears in the above-identified patent and that said Letters Patent is hereby corrected as shown below:

Column 22, line 16, "feed was feed directly to the GC system for analysis."
should read -- feed was fed directly to the GC system for analysis. --.

Column 23, line 65, "The process of claim 4, wherein said wherein said"
should read -- The process of claim 4, wherein said --.

Column 28, line 12, "regenerating at least a portion of said sorb ent with an"
should read -- regenerating at least a portion of said sorbent with an --.

Signed and Sealed this

Seventeenth Day of June, 2008

JON W. DUDAS
*Director of the United States Patent and Trademark Office*